US006115900A

United States Patent [19]

Cerulo et al.

[11] Patent Number: 6,115,900

[45] Date of Patent: Sep. 12, 2000

[54] HAND RIVET SETTING TOOL

[75] Inventors: Michael A. Cerulo, Trumbull; William A. Burbank, Newtown, both of Conn.

[73] Assignee: Emhart Inc., Newark, Del.

[21] Appl. No.: 09/208,235

[22] Filed: Dec. 9, 1998

Related U.S. Application Data

[60] Provisional application No. 60/070,199, Dec. 30, 1997.

[51] Int. Cl.[7] ..... B21J 15/34

[52] U.S. Cl. ..... 29/243.521

[58] Field of Search ..... 29/243.521, 243.527, 29/243.528

[56] References Cited

U.S. PATENT DOCUMENTS

| | | | |
|---|---|---|---|
| D. 201,832 | 8/1965 | Fuller, Jr. . | |
| 226,159 | 1/1973 | Di Maio . | |
| 3,100,578 | 8/1963 | Halverson et al. . | |
| 3,280,615 | 10/1966 | Molitor et al. . | |
| 3,302,444 | 2/1967 | Elliot . | |
| 3,426,572 | 2/1969 | Lahnston . | |
| 3,543,560 | 12/1970 | Harris . | |
| 3,561,249 | 2/1971 | Freeman . | |
| 3,596,496 | 8/1971 | La Pointe . | |
| 3,753,524 | 8/1973 | Heyward . | |
| 3,782,165 | 1/1974 | Bosch | 29/243.528 |
| 3,831,424 | 8/1974 | James . | |
| 3,842,649 | 10/1974 | Di Maio . | |
| 3,886,782 | 6/1975 | Miyamoto . | |
| 4,353,239 | 10/1982 | Fujimoto | 29/243.528 |
| 4,807,460 | 2/1989 | Tzong | 29/243.528 |
| 5,361,474 | 11/1994 | Yang . | |
| 5,437,085 | 8/1995 | Liu | 29/243.521 |

FOREIGN PATENT DOCUMENTS

| | | |
|---|---|---|
| 2123499 | 9/1972 | France . |
| 2307054 | 8/1974 | Germany . |

*Primary Examiner*—David Jones
*Attorney, Agent, or Firm*—Edward D. Murphy

[57] ABSTRACT

A hand-operated blind rivet setting tool having a compound link mechanism for increasing advantageously the mechanical ratio between its moving parts. A one-digit, one-handed latching and unlatching feature is provided, as well as a jam-free environment for the rivet-mandrel used with the tool during the rivet-setting cycle. Two easily assembled subassemblies of the tool combine for error-free assembly and disassembly.

17 Claims, 4 Drawing Sheets

FIG. 2
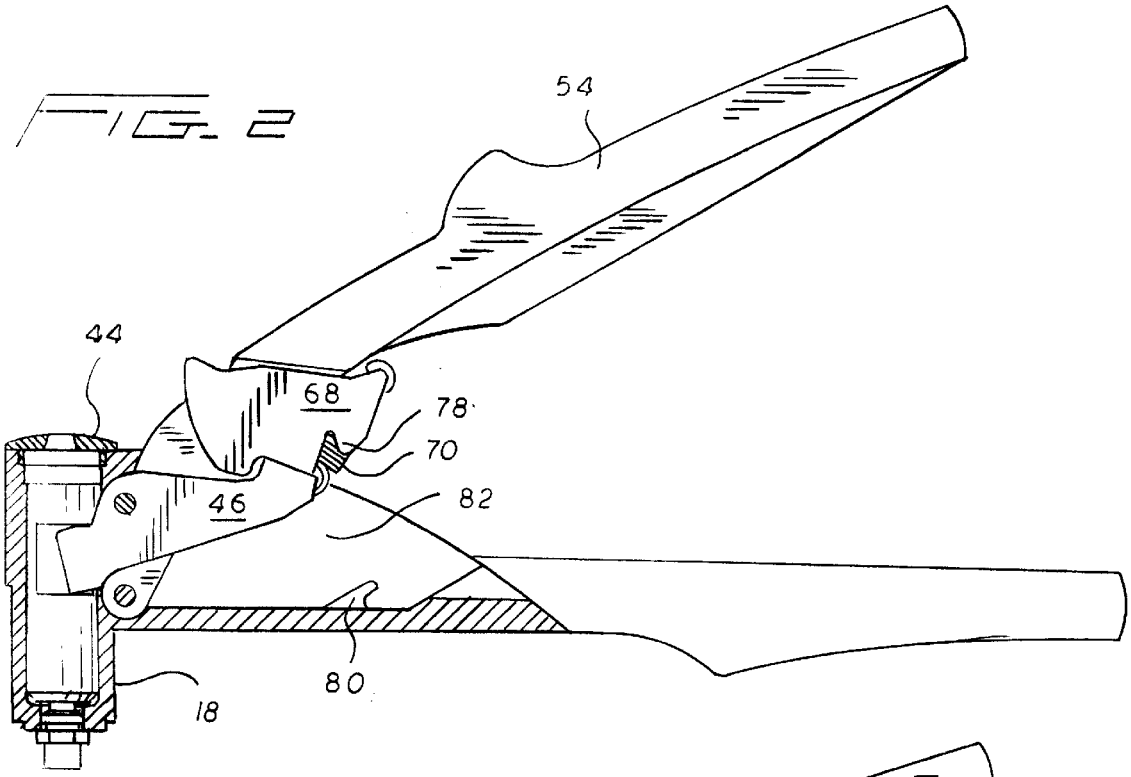
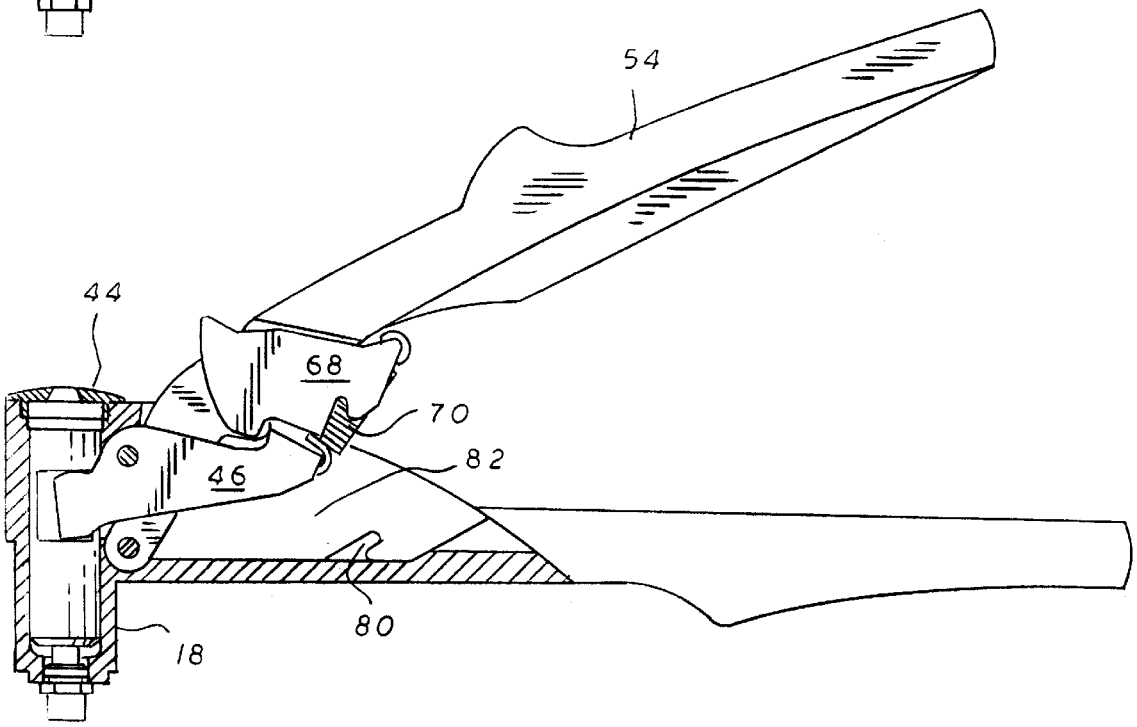
FIG. 3

HAND RIVET SETTING TOOL

This application is a continuation of Provisional Application Ser. No. 60/070,199 filed Dec. 30, 1997.

BACKGROUND OF THE INVENTION

This invention relates to a blind rivet setting tool, particularly a hand manipulated tool for setting rivets using break-off mandrels.

Such tools are essentially similar in operation, that is, they operate on the principle of a pair of pliers using a scissoring action to move or translate a jaw carrier member (carrying the rivet) from a rivet-inserting position to a rivet-setting position, allowing then the broken-off mandrel portion of the rivet to be ejected from the tool and for a new rivet to be inserted into the nose piece of the tool. Problems inherent in this kind of operation generally relate to the camming action between the handles of the tool and the jaw carrier so that enough mechanical ratio is generated to allow for a viable manual operation. Also, the need to move a rivet through the tool's operating cycle—placing, setting and ejection—without snagging or obstructing the moving parts of the tool can be a challenge. Other functions of the tool such as latching and unlatching of the handle members, providing a spring-bias and allowing for the ready assembly and disassembly of the tool have often been unsatisfactory.

OBJECTS AND SUMMARY OF THE INVENTION

It is a primary purpose and principle object of the present invention to address the aforementioned areas of concern and provide a blind rivet setting tool that will operate efficiently and continuously without jamming or otherwise require an inordinate effort for manipulating the tool.

A feature of the present invention is the provision of a compound link mechanism that increases advantageously the mechanical ratio and friction-reduction between the moving parts of a hand manipulated blind rivet tool. The mechanical advantage so achieved by the present design is numerically greater than past designs and allows for a one-handed as well as two-handed operation and hence a shorter handle closure travel distance for a longer jaw carrier travel distance than in conventional designs. The handle closure travel distance allows the maximum "hand-open" distance to be less than what is presently allowed in conventional designs, "hand-open" being the average distance between a human's finger tips and the palm of the hand, so that a decrease in hand-open distance enhances then a one-handed operation of the tool.

Another feature of the invention is the special design of the handles of the tool that allows for a reduction in the number of strokes needed to set a rivet than what is ordinarily required to set a rivet with a conventional tool.

Still another feature of the present invention is a one-digit, one-handed latching and unlatching operation that allows the handle members of the tool to be latched in their closed position. Further, the latch mechanism has "memory" so that the latched position for the tool can be set at any time whether the handles are closed or open. Additionally, the latching member easily clicks into either of its two positions, latched and unlatched, and assumes those positions in a lower energy state, thus making it easier for the user to latch the tool. In addition, the improved latch is located so that it is easier to use and less likely to snag on other objects.

Yet another feature of the present invention is to provide a jam-free environment for the rivet mandrel used with the tool so as to avoid sticking or jamming of the mandrel at any point in the rivet-setting cycle but especially during the mandrel ejection phase.

Another feature of the invention is the provision of a convenient storage space within the tool for the storage of auxiliary nose pieces and wrenches used with the tool.

Still another feature of the invention is the arrangement of the parts with one another, so that an easy and error-free assembly of the parts is assured should it be desired to disassemble the tool for cleaning or replacement of parts. Accordingly, only two subassemblies are required, one easily fitted into the other to complete the tool assembly.

According to one embodiment of the invention a compound link mechanism, including the operating handle for connecting to the jaw carrier, makes for a mechanical ratio that varies significantly over a wide range (from 4 or 5:1 to 30:1) during handle closure so as to enhance the amount of force a human must apply to any one part of the stroke along the stroke path. This large variation in mechanical ratio—which gives the tool its "feel"—is achieved through a camming action between the operating handle and the link member and also between the latter and the jaw carrier, the link member being the intermediate member between the operating handle and the jaw carrier. Towards this end the link member has a separate and critically-located pivot from that of the operating handle. Further, friction reduction between the operating handle, link and jaw carrier is accomplished through the contour and dimensions of the link member, the bearing surfaces that contact one another and, as well, the relationship between the pivotal axes of the link member and the operating handle of the tool.

Compared with mechanical ratio ranges for such tools in the prior art (which usually vary from 17:1 to 19:1) the wide variation in range of mechanical ratio (4 or 5:1 to 30:1) afforded by the present invention allows for a variation in the design of the tool; specifically, the tool may be designed to emphasize one or more of these particular operational features. Thus, by using the tool's full range of mechanical advantage (up to 30:1) an easier rivet set can be effected; alternatively, by reducing that range somewhat (5:1 to 20:1, say), either a longer distance of jaw carrier travel per stroke may be provided, thus requiring fewer strokes than is otherwise normal for setting a rivet; or the tool can be made more compact than conventional tool designs. Each of these possible designs of course will have its advantages for different users of the tool and for different applications. Thus, the tool using the parts as described below can be designed for different markets in which one or the other, or even some particular combination, of the three design criteria above-mentioned is deemed to be important for that market.

The latch member for the tool, according to the invention, is conveniently located near the front of the tool within easy reach of the user's fingers when gripping the tool during normal usage. The latch is designed to straddle the operating handle between the body of the tool and the handle itself on either side thereof, thus contributing to the stability of the operating handle with respect to the body of the tool. Further, the latch member is connected to the aforementioned link member by means of an over-center extension spring. The spring in conjunction with other components causes the operating handle to open (in the unlatched condition) when the user's grip is relaxed, thus releasing the tool's hold on the rivet mandrel and allowing the spent mandrel (once it has broken off) to fall free of the tool. The latch is easily moved into either of its two positions, latched and unlatched, and clicks into place by means of the over-center action of the extension spring connecting it to the link member. In this way the latch member "remembers" what position it is in, latched or unlatched, and stays in that position regardless of whether the operating handle is closed or open.

The invention further provides for snag-free mandrel ejection by preventing the formation of any interruptions in the exit passage for the mandrel; thus, the retaining screw for the jaw pusher at the top of the jaw carrier as well as the compression spring for biasing the jaw pusher are both confined to the outside surface of the jaw pusher.

Additional nose pieces and wrench accessories supplied with the tool are placed into cavities built into the two handle gripping portions, the cavities or recesses being located in the inside facing areas of the lower stationary handle and the upper operating handle. Thus the cavities provide for concealed and secure storage of the accessories when the tool is latched closed, and this same feature allows the accessories to be plainly visible and easily accessible when the tool is in its open position. Because the upper operating handle fits snugly over the upper parts of these accessories when the tool is in its closed position, the accessories do not interfere with the closure of the handles, allowing then for maximum closure and hence a maximum jaw carrier movement or travel distance.

Both the compound linkage mechanism and the maximum closure feature referred to above contribute to using a minimum number of strokes per cycle for a given rivet-setting cycle; that is, in the order of two or three strokes, it has been found, rather than the four or five strokes required by conventional designs.

Finally, the tool according to the invention is designed for an easy and error-free assembly from two subassemblies, a tool body and lower handle subassembly, and an upper handle and latch-link subassembly. Each of these subassemblies in turn can be easily assembled or disassembled in an error-free manner. For example, in the case of the first subassembly, the compression spring and jaw pusher which it surrounds are shaped such that the jaw pusher is self-centering within the jaw carrier and within the coils of the spring, preventing then the spring from snagging on either the jaw pusher or the retaining screw during assembly. The compression spring causes the jaw pusher to be sufficiently aligned with the jaw carrier and the jaws themselves, such that the retaining screw cannot snag on the jaw pusher during assembly. Nor will the compression spring bind in the jaw carrier threads during assembly nor cause any interference in the clearance gap provided between the jaw pusher and the retaining screw, since the spring surrounds the jaw pusher. Finally, the retaining nut is designed to be completely symmetrical which means it can be fitted to the jaw carrier either frontwards or backwards without needing to be reversed once it is assembled to the tool.

In the case of the second subassembly above mentioned, the upper operating handle, latch member, extension spring, and link member are assembled by means of the extension spring connection between the link and latch members. Specific surfaces on the latch, link and handle members are designed to engage each other so that the extension spring is assembled thereto in its lowest energy state, thus reducing chances of injury during assembly.

The one subassembly is easily fitted into the other subassembly to complete the tool assembly; thus, a cavity in the tool body subassembly facilitates location of the upper or operating handle subassembly for the ready insertion of the two separate fulcrum pins required for linking the two subassemblies together, one of the fulcrum pins connecting the link member to the tool body and the other connecting the upper operating handle to the tool body.

While two subassemblies for the tool have been described, the tool according to the invention can also be viewed from a different perspective wherein a fixed tool body is seen to host two movable subassemblies, namely the jaw carrier as one subassembly and the operating handle, link member and latch member as the other subassembly, the latter subassembly of course corresponding to the second subassembly described above.

The invention will be better understood as well as further objects and advantages thereof become more apparent from the ensuing detailed description taken in conjunction with the drawings.

BRIEF DESCRIPTION OF THE DRAWINGS

FIG. 2 is a schematic side elevational view, partly in section, showing the fully assembled tool of FIG. 1 in its fully opened position;

FIG. 3 is a schematic side elevational view, partly in section, showing the tool of FIG. 2 in a partially closed position;

DETAILED DESCRIPTION

Figure 1:
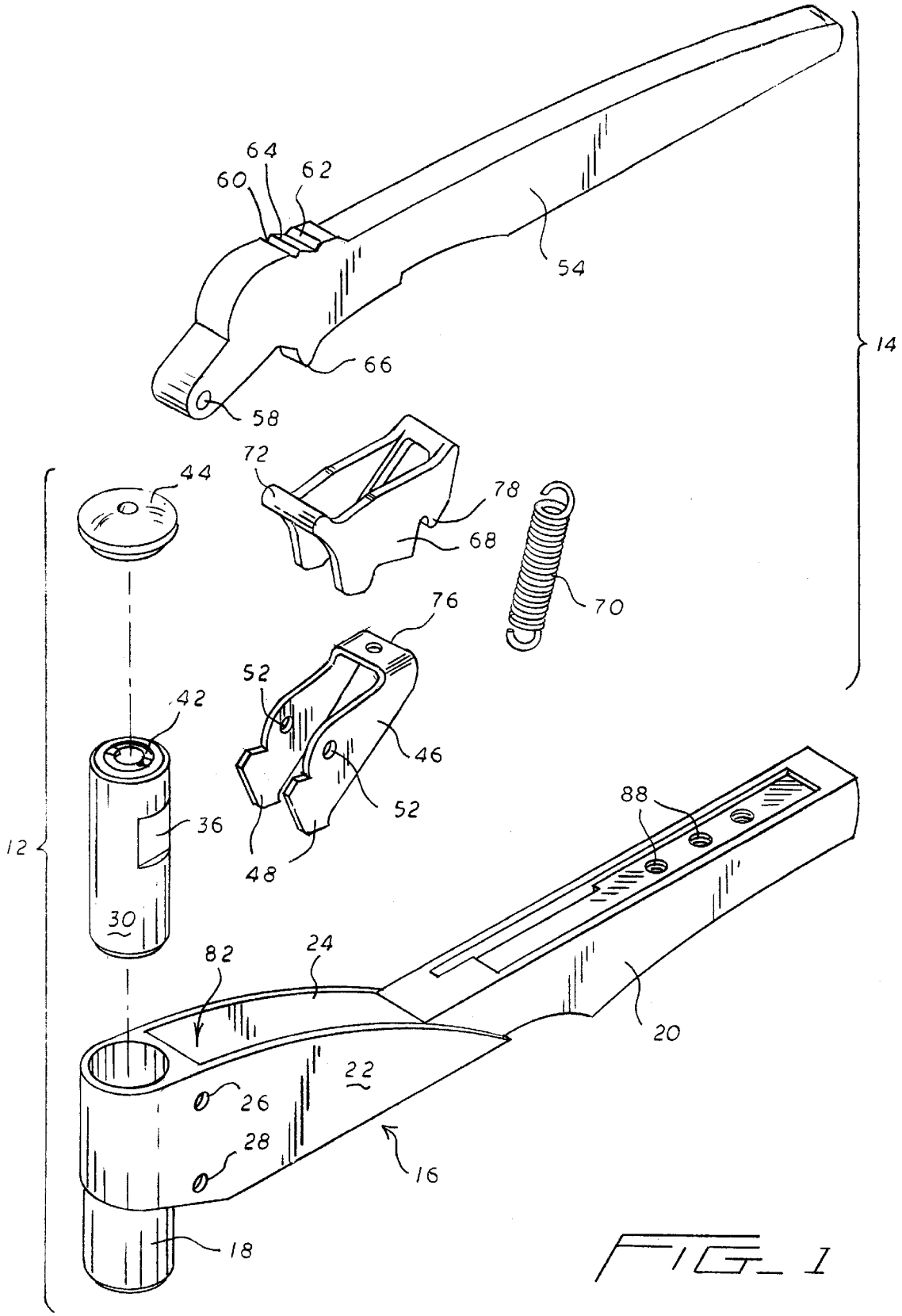
FIG. 1 is an explosive schematic perspective view of the blind rivet tool according to the invention.

Referring to FIG. 1–6, there is shown the hand rivet tool 10, according to the invention, that now will be described in terms of the two subassemblies 12 and 14 that make up the tool (see FIG. 1). In the tool body subassembly 12 consists of an integral body element 16 that at its front end is formed by a cylindrical housing 18 and at its rear a stationary handle member 20. The sidewalls 22, 24 are seen to have aligned holes 26, 28, the purpose of which will be explained shortly. The cylindrical housing at its lower end is seen to have a threaded opening (see FIG. 2) for the reception of an appropriate nose piece used with the tool in the conventional manner for a particularly sized rivet. Within the cylindrical housing 18 fits the jaw carrier 30, carrying jaws 32 (see FIGS. 2 and 6), and the jaw pusher 34 (see FIG. 6), which cooperate together in the conventional manner for gripping and releasing a rivet mandrel stem. The jaw carrier is seen to have a pair of opposed recesses 36 (see FIG. 6) for cooperating with the link member associated with the upper handle subassembly to be discussed further below.

Surrounding the jaw pusher 34 is a compression spring 38 (see FIG. 6), one end of which bears against the flange portion 40 of the jaw pusher and the other end of which bears against a retaining screw 42 that screws into the top of the jaw carrier and that slidably receives the top end of the jaw pusher. With this arrangement it will be seen that the mandrel stem of the rivet has a smooth passage in which to travel from where it is gripped by the jaws 32 to where it can exit, at the top of the tool (when the tool is turned over), through the retaining nut 42 and a cap member 44 with a hole, if such is used, once the jaws are released from their grip on the mandrel stem in the conventional manner.

The subassembly 12, then, is seen to be easily assembled in an error-free manner by placing the jaws 32 into the conically shaped bottom of the jaw carrier 30, then inserting the jaw pusher 34 whose V-shaped tip will align automatically with the V-shaped depression defined by the jaw members, then dropping the compression spring 38 over the jaw pusher, and then screwing the retainer nut 42 into the top of the jaw carrier. The retainer nut 42 is symmetrical in design, so that it is not necessary to screw it into the top of the carrier in only one given way but can be reversed and still operate properly as an exit path for the spent mandrel.

Figure 7:
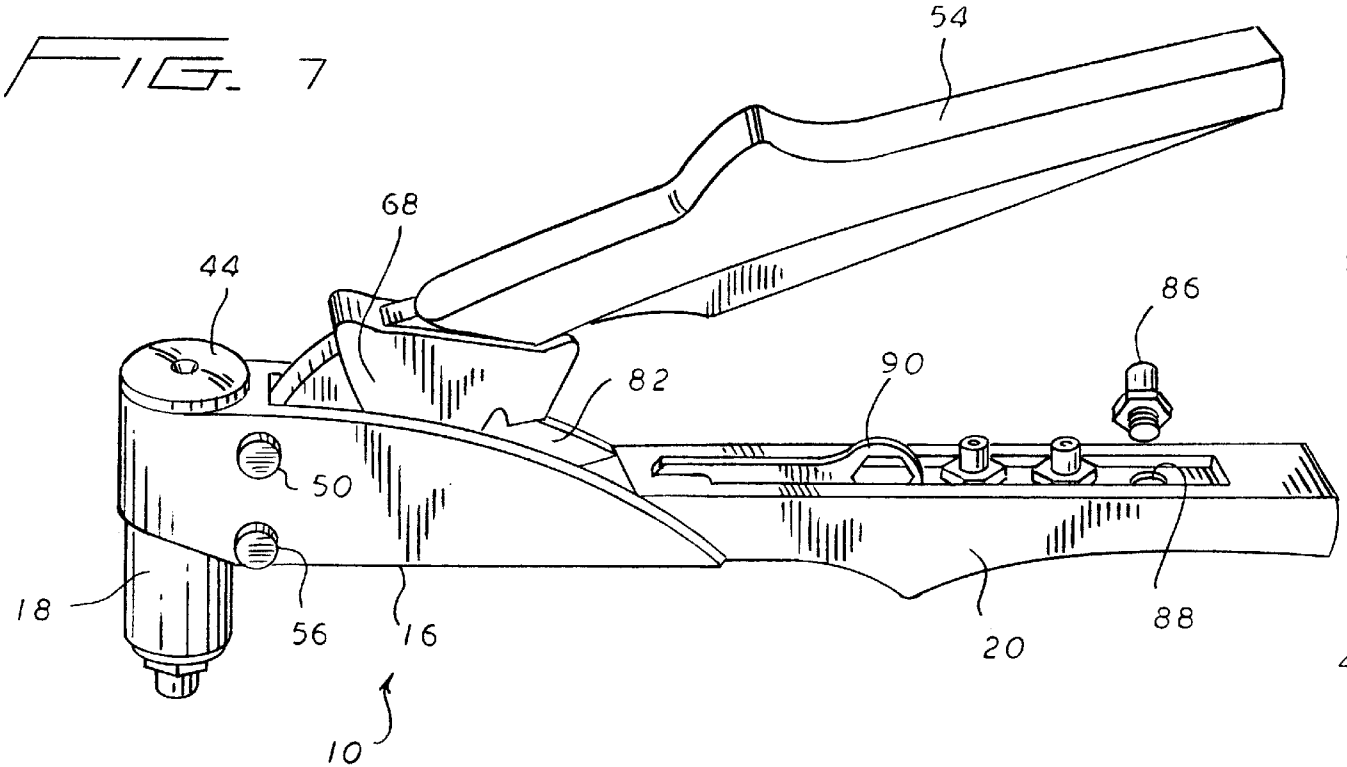
FIG. 7 is a schematic perspective view of the tool in which the auxiliary nose piece storage feature is shown.

The subassembly 14 will now be described. Connecting the jaw carrier of the subassembly 12 with the sub assembly 14 is a U-shaped link member 46, having a pair of ears 48 that engage the opposed recesses 36 of the jaw carrier 30. The pivotal connection between the ear members 48 and the recessed portions 36 will be discussed in greater detail below. At this point it will be seen that the link member 46 is the forward-most part of the subassembly 14. A pivot for the link member is provided by a fulcrum pin 50 (see FIG. 7) extending through opposed holes 52 in the sidewalls of the link member and through aligned holes 26 in the sidewalls 22, 24 of the tool body 16.

The link member 46 is seen to straddle the upper operating handle 54 which itself is pivoted about fulcrum pin 56 (see FIG. 7) extending through hole 58 in the operating handle 54 and aligned holes 28 in the sidewalls 22, 24 of the tool body 16, which pivotal axis is directly below that of the link member 46 (see FIGS. 2–5). Operating handle 54 extends rearwardly and is generally curved to define on its upper surface a pair of notches 60, 62 separated by a camming surface 64 and on its lower extension an abutment surface 66 which cooperates with a camming surface 76 on the hindmost end of the link member 46, to be discussed in greater detail below.

Figure 4:
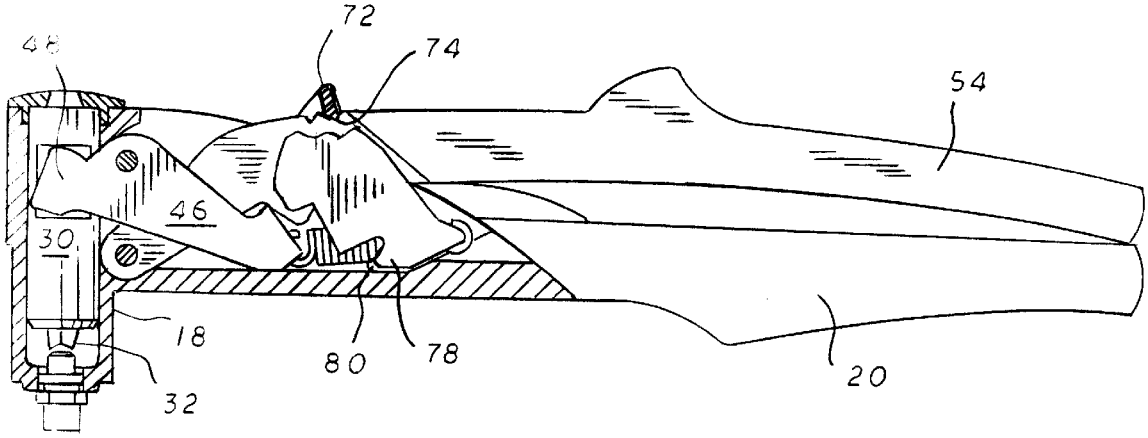
FIG. 4 is a schematic side elevational view, partly in section, showing the tool of FIG. 3 in the fully closed position with the latch member in the latched position.
Figure 5:
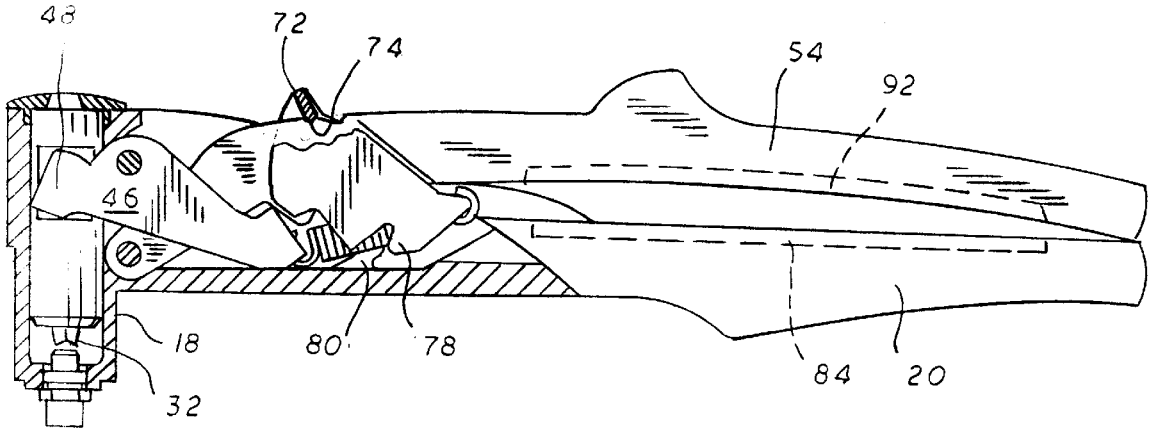
FIG. 5 is a schematic side elevational view, partly in section, of the tool shown in FIG. 4 in the fully closed position with the latch member in the unlatched position.
Figure 6:
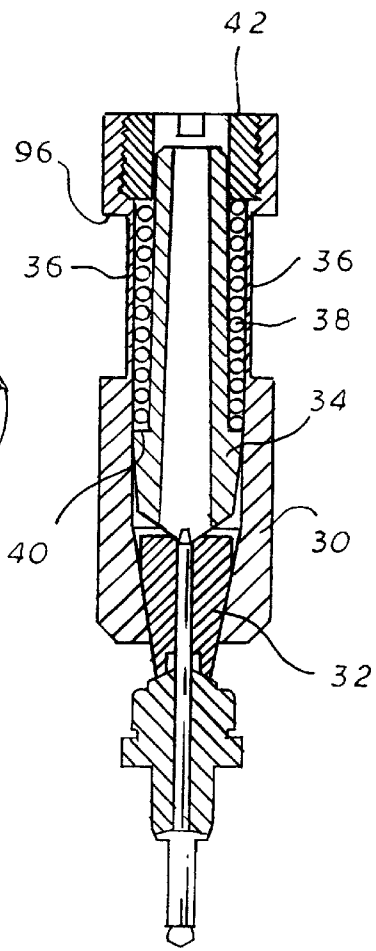
FIG. 6 is a schematic front elevational view, fully in section, of the tool according to the invention in which the parts of the jaw carrier are shown.

A U-shaped latching member 68 straddles the operating handle 54 in the same way that the link member 46 straddles the operating handle, only in this case the latch member is not pivoted about a fulcrum but rather is connected from its hindmost portion by an extension spring 70 to the hindmost portion of the link member 46, as best shown in FIGS. 2–5. An upper end of the latch member 68 serves as a manual button 72 whose interior surface forms a detent 74 that rides across the top surface of the operating handle 54 and engages alternatively the notches 60, 62, as best shown in FIGS. 4 and 5. Depending upon which way the manual button 70 is moved determines in which direction the spring 70 moves past its over-center position to allow the latch member 68 to position itself in one of two positions; either in the forward unlatched position (see FIG. 5) in which the detent 74 is positioned in the unlatched forward notch 60, or in the rearward latched position (see FIG. 4) in which the detent 74 is positioned in the rearward notch 62. In each case the latch member moves into either one of these positions with a clicking sound owing to the detent 74 riding over the camming surface 64 between the notches. The detent 74 remains in either position until it is manually removed from either position.

Consequently, the latch member 68 exhibits "memory" when switched from a latch position to an unlatched position, regardless of whether the handle members 54 and 20 are closed or open with respect to one another. For example, if the latch member 68 is moved to its rearward latched position when the operating handle 54 is open (see FIGS. 2 or 3), it will retain that position until the handles 54, 20 are closed upon one another, in which case the handle members will become latched by virtue of the hook portion 78 of the latch member biasing or snapping past the upstanding catch member 80 on the bottom of tool body 16 into its latched position underneath the catch member, as best shown in FIG. 4. On the other hand, if the latch member 46 is moved forwardly to its unlatched position when the handle members are open, then closing them will make no difference, since the hook portion 78 and the and catch member 80 will bypass one another because of their respective fixed positions, as shown in FIG. 5.

It should be understood, of course, that these fixed positions of the unlatched and latched positions of the latch member are made possible by the over-center action of the extension spring 68 which moves to either of its low energy states when the latch member is moved to one or the other of its two extreme positions.

Having described the tool body subassembly 12 and the operating handle subassembly 14, it remains now to show how these two subassemblies are easily fitted together to complete the tool assembly. The tool body 16 is seen to have a recessed portion or cavity 82 into which the operating handle subassembly 14 easily slides to an operative position. The ears 48 of the link member 46 assume their positions in the respective recessed portions 36 of the jaw carrier 30, and the latter can be easily rotated to make the recessed portions 36 accessible to the ears 48. Once the ears slide into place in the slots made possible by the recessed portions 36 and the inner walls or surface of the cylindrical housing 18, they will remain in place, owing to the next step to be described.

As previously mentioned, another way to view the tool according to the invention is to see it as a fixed tool body 16 having no moving parts which acts as a host to the two subassemblies somewhat similar to the ones described above, one being the jaw carrier 30 with its internal parts that fits into the cylindrical housing 18 of the tool body, and the other subassembly being the same as that already described, namely the operating handle 54, the link 46, the latch 68 and the spring 70 connecting these last two parts. Thus, the first subassembly is placed into the cylindrical housing 18, and the second subassembly is then inserted into the cavity or recess 82, as above described.

It will be seen that the pivotal holes 52 of the link member 46 will line up with the holes 26 in the sidewalls 22, 24 of the tool body 16. Also, the pivotal hole 58 in the operating handle 54 will line up with the holes 28 in the sidewalls of the tool body. The fulcrum pins 50, 56, which may be of a conventional design, are then inserted into the respectively aligned holes of the tool and are secured in place by a suitable means such as spring clips or the like.

The U-shaped link member 46 and the lower part of the operating handle 54 which it straddles cross one another in order to reach their pivot points (see FIGS. 2–5). The pivot hole 58 for the operating handle defines then the farthest distance from its one end to the opposite end of the handle, while the pivot holes 52 for the link 46 define the farthest distance between its one end and that part of the opposite end that allows for the ears 48 to engage the recessed portions 36 of the jaw carrier 30.

This compound linkage, according to the invention, provides for a wide range of mechanical ratio over the length of the stroke of the jaw carrier when the two handles 20 and 54 are squeezed together. Thus, for a rivet setting cycle the relatively long length of the link member 46 is caused to pivot about its fulcrum pin 50 which allows the relatively short length of the ears 48 to push up at a great mechanical advantage against the upper ledges 96 (see FIG. 7) of the recessed portions 36 in the jaw carrier when the camming surface 76 of the link is pushed downward by the abutment surface 66 near the pivotal end of the operating handle 54.

The separate pivots for the operating handle and the link member are as close as possible to the jaw carrier while spaced from one another as far as possible so as to allow for the maximum mechanical moments of the handle 54 and link 46 to operate within a relatively confined space. This arrangement makes for a compact tool that can be readily grasped and operated by a single hand of the user, if so desired.

As previously mentioned, the wide range of mechanical ratio produced by a tool design in accordance with the present invention permits a previously unavailable variation in the structure of specific tools so that the needs of different users having different applications of the tool can be addressed by different tool models. In particular, a specific tool model may be designed to utilize the full range of mechanical advantage, up to as much as 30:1. In this case, the force required to set a particular rivet will be significantly less than with conventional tool designs. In other tool models, a reduced mechanical advantage (for example, from 5:1 to 20:1), may be selected. A first tool design may then be produced in which a longer jaw carrier travel is achieved so that the tool requires fewer strokes to set a given rivet than is required by conventional tools. Alternatively, instead of designing for a longer jaw carrier travel, another tool may be designed which operates with approximately conventional force levels and stroke, but which is significantly more compact than conventional tools. Combinations of these features may also be effected as desired.

The lower handle 20 of the tool body 16 is seen to have a cavity 84 along the inside surface thereof for receiving a number of auxiliary nose pieces 86 used with the tool and for accommodating it with different sized rivets in the conventional manner. Each of the nose pieces 84 will be seen to fit into individually formed recesses 88 in the cavity. Further, a slot or slots may be provided for accommodating one of more wrenches 90 used with the tool, as shown. A complementary cavity or recess 92 (see FIG. 5) is also provided on the inside surface of the operating handle 54, so that when the two handles are squeezed together, the cavities 84 and 92 can fully accommodate the nose pieces and wrenches without having these elements interfere with the handles coming fully together for maximizing a given stroke.

The foregoing relates to a preferred exemplary embodiment of the present invention, it being understood that other embodiments and variants thereof are possible within the scope of the invention, the latter being defined by the appended claims.

What is claimed and desired to be secured by Letters Patent of the United States is:

1. A hand-operated tool for setting a blind rivet, comprising a tool body, including a stationary handle, a cylindrical housing formed about an axis thereof, and a recess communicating with said cylindrical housing, a jaw carrier subassembly fitting within said cylindrical housing of said tool body, an operating handle and a link member subassembly fitting within said recess of said tool body for allowing one end of said link member to engage said jaw carrier, a first pin connecting one end of said operating handle to said tool body, and a second pin disposed adjacent said first pin, with the first and second pins being located in a common plane which is parallel to the axis of the cylindrical housing, for connecting said link member to said tool body near said end of said end of said link member engaging said jaw carrier, whereby said operating handle is caused to press against the other end of said link member when said operating handle is pivoted about said first pin.

2. A hand-operated tool according to claim 1, wherein said operating handle and link member subassembly further includes a latch member connected to said link member by a spring, said latch member and said link member being U-shaped and straddling said operating handle, and said latch member having a detent for engaging either one of a pair of notches on said operating handle against the bias of said spring, said notches corresponding to a latch-engaging position and a latch-disengaging position for said latch member, regardless of whether said operating handle is opened or closed with respect to said stationary handle.

3. A hand-operated tool according to claim 1, wherein said jaw carrier further comprises, a set of jaws at one end thereof for grasping the mandrel of said rivet, a jaw pusher having a smooth internal bore disposed within said jaw carrier and concentric with the axis of said jaw carrier, a compression spring surrounding said jaw pusher and being biased between one end of said jaw carrier and a ledge on said jaw pusher, whereby the mandrel when released from said jaws exits said tool through said smooth internal bore of said jaw pusher.

4. A hand-operated tool according to claim 1, wherein said operating handle and said stationary handle each have an opposite facing cavity therein extending along a substantial length thereof, socket means in one of said cavities for storing auxiliary nose pieces used with said tool, and said cavities together closing over said auxiliary nose pieces when said handles are squeezed together.

5. A hand-operated tool for setting a blind rivet, comprising a tool body having an stationary handle and a jaw carrier, an operating handle pivoted to said tool body, a link member pivoted to said tool body and having one end engaging said jaw carrier and the other end acted upon by said operating handle, a U-shaped latch member connected by a spring to said link member and straddling said operating handle, and said latch member having a detent for engaging respectively one of a pair of notches in said operating handle for establishing either a latched position or an unlatched position, regardless of whether said handles are opened or closed with respect to one another.

6. A hand-operated tool according to claim 5, wherein said spring defines an over-center movement thereof when said latch member is moved to either said latched position or said unlatched position, whereby said spring is in a relatively lower energy state when said latch member is in either of said positions.

7. A hand-operated tool according to claim 6, wherein a camming surface is disposed between said notches of said pair for camming said movement of said latch member to either one of said notches of said pair, and said latch member further having a hook member for biasingly engaging a catch member on said tool body when said latch member is in said latched position and said operating handle is closed upon said stationary handle.

8. A hand-operated tool for setting a blind rivet, comprising a tool body having an stationary handle and a jaw carrier, an operating handle pivoted to said tool body, a link member pivoted to said tool body and having one end engaging said jaw carrier and the other end acted upon by said operating handle, and said operating handle and said stationary handle each having an opposite facing cavity extending along a substantial length thereof, socket means in one of said cavities for storing auxiliary nose pieces used with said tool, and said cavities together closing over said auxiliary nose pieces when said handles are squeezed together.

9. A hand-operated tool according to claim 8, wherein said one of said cavities defines a pocket for receiving a wrench used with said tool, and said cavities together closing over said wrench when said handles are squeezed together.

10. A hand-operated tool for setting a blind rivet, comprising a tool body having an stationary handle and a jaw carrier, an operating handle pivoted to said tool body, a link member pivoted to said tool body and having one end engaging said jaw carrier and the other end acted upon by said operating handle, said jaw carrier having a set of jaws at one end thereof for grasping the mandrel of said rivet, a jaw pusher disposed within said jaw carrier and having a smooth internal bore concentric with the axis of said jaw carrier, a retaining nut having a bore therethrough located at the other end of said jaw carrier, one end of said jaw pusher extending into the bore of said retaining nut, and a compression spring surrounding said jaw pusher and biased between said retaining nut and a ledge portion on said jaw pusher, whereby the mandrel when released from said jaws exits said tool through said smooth internal bore of said jaw pusher and the bore of said retaining nut.

11. A hand-operated tool according to claim 10, wherein said retaining nut is screw-threaded from either end thereof into said jaw carrier.

12. A hand-operated tool for setting a blind rivet, comprising a tool body having a stationary handle, a jaw carrier mounted for movement within said tool body, an operating handle pivoted to said tool body, a U-shaped link member pivoted to said tool body and straddling said operating handle, the open end of said link member defining a pair of ears for engaging respective portions of said jaw carrier, and the closed end of said link member being acted upon by the underside of said operating handle when moved towards said stationary handle.

13. A hand-operated tool according to claim 12, wherein the pivot in said tool body for said link member is separated from the pivot for said operating handle.

14. A hand-operated tool according to claim 12, further comprising a latch member connected to said link member by a spring, said latch member being U-shaped and straddling said operating handle, and said spring normally biasing said operating handle to an open position with respect to said stationary handle.

15. A hand-operated tool according to claim 13, wherein said latch member includes a detent for engaging either one of a pair of notches on said operating handle against the bias of said spring, said notches corresponding to a latch-engaging position and a latch-disengaging position for said latch member, regardless of whether said operating handle is opened or closed with respect to said stationary handle.

16. A hand-operated tool for setting a blind rivet, comprising a tool body having a stationary handle, a jaw carrier mounted for movement within said tool body, an operating handle pivoted to said tool body, a U-shaped link member pivoted to said tool body and straddling said operating handle, the open end of said link member defining a pair of ears for engaging respective portions of said jaw carrier, and the closed end of said link member being acted upon by the underside of said operating handle when moved towards said stationary handle, a U-shaped latch member connected by a spring to said link member and straddling said operating handle adjacent said U-shaped link member, and said latch member having a detent for engaging respectively one of a pair of notches in said operating handle for establishing either a latched position or an unlatched position, regardless of whether said handles are opened or closed with respect to one another.

17. A hand-operated tool for setting a blind rivet, comprising a first subassembly including a tool body, a stationary handle, a cylindrical housing formed about an axis thereof, a jaw carrier disposed in said housing, and a recess in said tool body communicating with said jaw carrier, a second subassembly including an operating handle, a latch member and a link member, said latch member being connected with said link member by a spring, a portion of said second subassembly fitting within said recess of said tool body for allowing one end of said link member to engage said jaw carrier, a first pin connecting one end of said operating handle to said tool body, and a second pin disposed adjacent said first pin, with the first and second pins being located in a common plane which is parallel to the axis of the cylindrical housing, said first pin for connecting said link member to said tool body near said end of said link member engaging said jaw carrier, whereby said operating handle is caused to press against the other end of said link member when said operating handle is pivoted about said first pin.

* * * * *